United States Patent [19]

Dossena et al.

[11] Patent Number: 4,726,726

[45] Date of Patent: Feb. 23, 1988

[54] DEVICE FOR LIFTING, TILTING AND DISCHARGING OF GARBAGE CONTAINERS INTO A GARBAGE TRUCK

[75] Inventors: Roberto Dossena; Marco Vedeo, both of Varazze, Italy

[73] Assignee: Valle Teiro S.r.l., Italy

[21] Appl. No.: 1,903

[22] Filed: Jan. 9, 1987

[30] Foreign Application Priority Data

Jan. 31, 1986 [IT] Italy ..... 12416 A/86
Oct. 27, 1986 [IT] Italy ..... 12654 A/86

[51] Int. Cl.[4] ..... B65F 3/02

[52] U.S. Cl. ..... 414/408; 414/404; 414/406; 414/549

[58] Field of Search ..... 414/404, 422, 406–409, 414/421, 425, 428, 486, 487, 583, 491–493, 549, 552, 555, 303, 546, 547

[56] References Cited

U.S. PATENT DOCUMENTS

| | | | |
|---|---|---|---|
| 3,016,157 | 1/1962 | Brisson | 414/408 |
| 4,175,903 | 11/1979 | Carson | 414/422 X |
| 4,219,298 | 8/1980 | Stragier et al. | 414/409 |
| 4,313,707 | 2/1982 | Bingman et al. | 414/409 |
| 4,543,028 | 9/1985 | Bell et al. | 414/549 X |

FOREIGN PATENT DOCUMENTS

| | | | |
|---|---|---|---|
| 2168316 | 6/1986 | United Kingdom | 414/409 |

*Primary Examiner*—Robert J. Spar
*Assistant Examiner*—Vien Nguyen
*Attorney, Agent, or Firm*—Jacobs & Jacobs

[57] ABSTRACT

A device for lifting, tilting and discharging of garbage containers into garbage trucks. The device includes a transverse mobile slider (3) located between the truck driver's cab (1) and the dump box (2), of a fixed or articulated double structural shaped upright (5) mounted on the mobile slider head (3), of a lever arm (7) oscillating on an articulated joint (6) located on the upper end of the upright (5), a longitudinal arm (10) oscillating on an articulated joint (9) located at the free end of the lever arm (7), a plate (12) moving along the longitudinal arm (10) and of a hook-up head (15) having the shape of a triangular prism oscillating on an articulated joint (14) located at the free end of the plate (12); this head (15) being provided with opposed and removable check pins (18) engaged in the related female part (21, 22, 23) mounted on one longitudinal wall of the garbage container (20) so as to reduce the overall dimensions of the equipment, to simplify its construction and assembly and to facilitate its operation by one single man.

6 Claims, 8 Drawing Figures

DEVICE FOR LIFTING, TILTING AND DISCHARGING OF GARBAGE CONTAINERS INTO A GARBAGE TRUCK

This patent covers a device for lifting, tilting and discharging of garbage containers into the collecting garbage truck. Several types of such equipment are already known, such as for instance devices mounted at the rear of the garbage truck which are sideways coupled by means of arms, to two pins or bolt teeth located on the sides of the garbage container.

Furthermore, rear mounted devices are known fitted with a lifting comb engaging in a counter-comb located on the longitudinal side of the garbage container.

All these known devices mounted on the rear side of the truck have the serious drawback that they cannot be directly operated by the truck driver but require special operators to move, position and hook up the containers for discharge and put them back in place.

Garbage trucks are also known where the device in question is positioned on one side, practically between the driver's cab and the truck body. These devices are consisting of arms which will hook up the pins of the container virtually in the same way as the devices mounted at the rear side of the truck.

Although trucks equipped with a lateral mounted device provide a better service, since the driver can discharge the containers by himself with the aid of mirrors or telecamera, the device so far known has a drawback in that it takes up much space thus reducing the capacity of the dump box of the truck.

Furthermore the lateral device so far known is rather complicated since it involves two arms sideways hooking up the container. Another disadvantage of this known lateral device lies in the fact that many moves are necessary to hook up the container.

A triangular coupling devices has been recently introduced on the market, which engages in a female mounted on the longitudinal side of the container.

This coupling system has a guillotine locking device and the container is lifted by means of a double vertical guided elevator. This solution too is rather complex, encumbersome and not very handy as far as hooking up is concerned.

This patent has the aim to eliminate or at least reduce the above mentioned drawbacks.

According to the patent, a lever arm is hinged onto an upright mounted, either fixed or articulated on a horizontally and transverse moving slider; furthermore, according to this patent, the container is hooked up on its longitudinal frontal surface by means of a triangular head mounted at the mobile end of the lever arm; since the head is transversely mobile and inclinable, it easily can be wedged and blocked in a mating female recess on the container.

Space requirements are thus reduced, the equipment is simplified and the operation can be performed more efficiently by one single person who is also driver of the truck.

The invention in question is illustrated in a practical implementation in the enclosed drawings, in which.

Figures 1, 2:
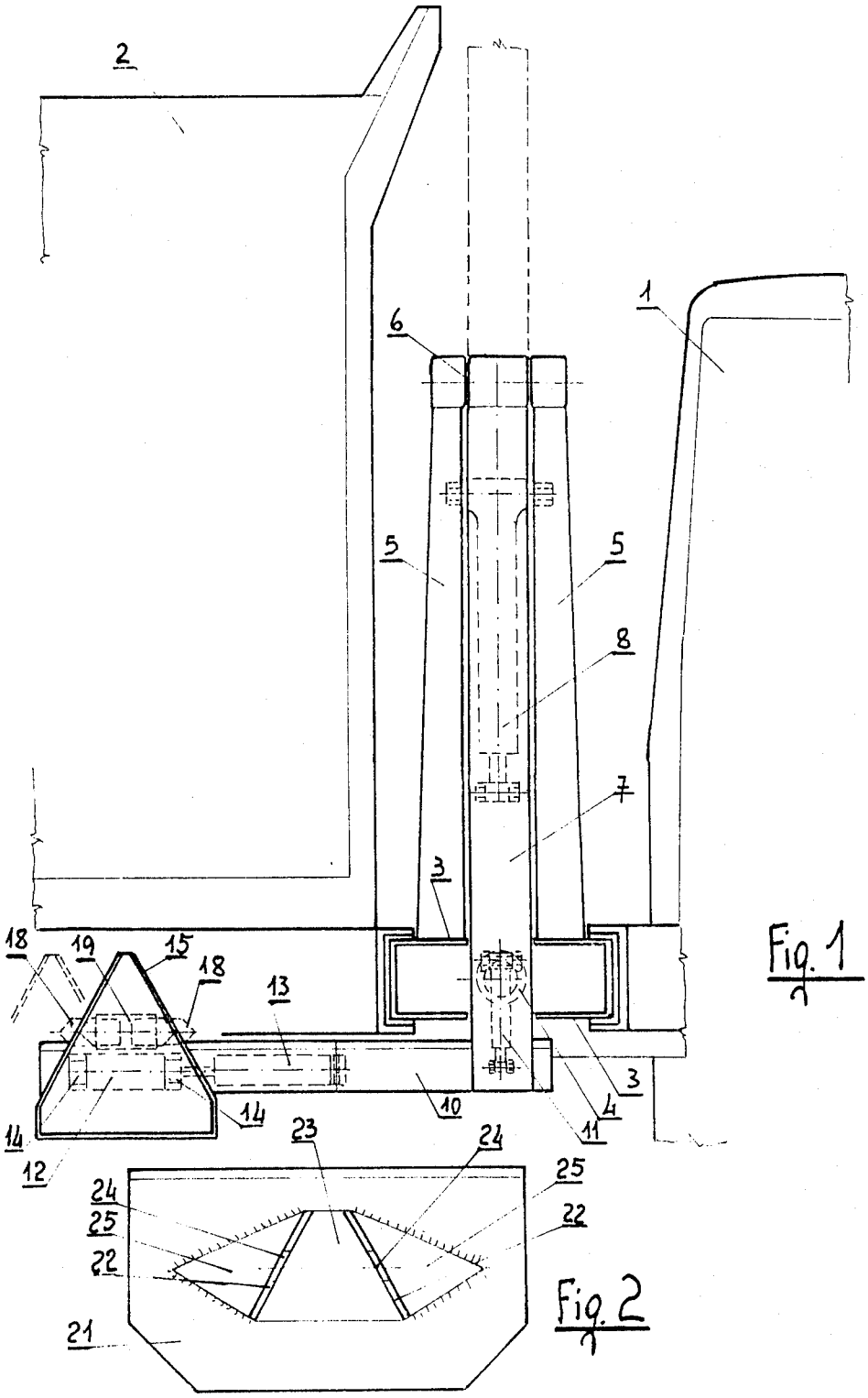
FIG. 1 shows a frontal view of the device according to the patent, with fixed upright.
FIG. 2 shows a frontal view of the female recess secured on the longitudinal side of the container.

With reference to the above illustrations, 1 refers to the driver's cab and 2 to the garbage collecting truck body. The truck body 2 is equipped with devices for garbage compaction and dumping according to known techniques.

A guided slider 3, actuated by a double acting piston and cylinder 4 located between the driver's cab 1 and the truck body. The slider 3 is transversally positioned on the bearing frame of the truck and its mobile head can be retracted within the truck dimensions or it can protrude on one side, usually the right side in countries with right-hand drive while in countries with left-hand drive, the slider will of course project on the left side.

An upright 5 consisting of a pair of spaced vertical sections is mounted on the mobile head of the slider 3, the top of the riser 5 is fitted with an articulated joint 6 with lengthwise horizontal axis.

The lever arm 7 oscillating between the two sections of the riser 5, is connected to the articulated joint 6. A double acting hydraulic fluid piston and cylinder 8 controls the oscillations of the lever arm 7 between its lowered and raised discharging position, illustrated by a continuous and a chain line respectively in FIGS. 1 and 3.

A lengthwise structural shaped arm 10, the length of which coincides with the truck body 2 is fastened onto the lever arm 7 by means of the articulated joint 9 with lengthwise horizontal axis. This section arm 10 oscillates around the articulated joint 9 controlled by a double acting hydraulic fluid piston and cylinder 11, so as to hook on the garbage container and lift it from the ground as explained hereinafter.

A plate actuated by a double acting hydraulic fluid piston and cylinder 13 is sliding in the section arm 10; at the outer end, this plate 12 is fitted with an articulated joint 14 bearing the coupling head 15 having the shape of a hollow triangular prism with slightly upwards slanting back surface.

Figures 3, 4:
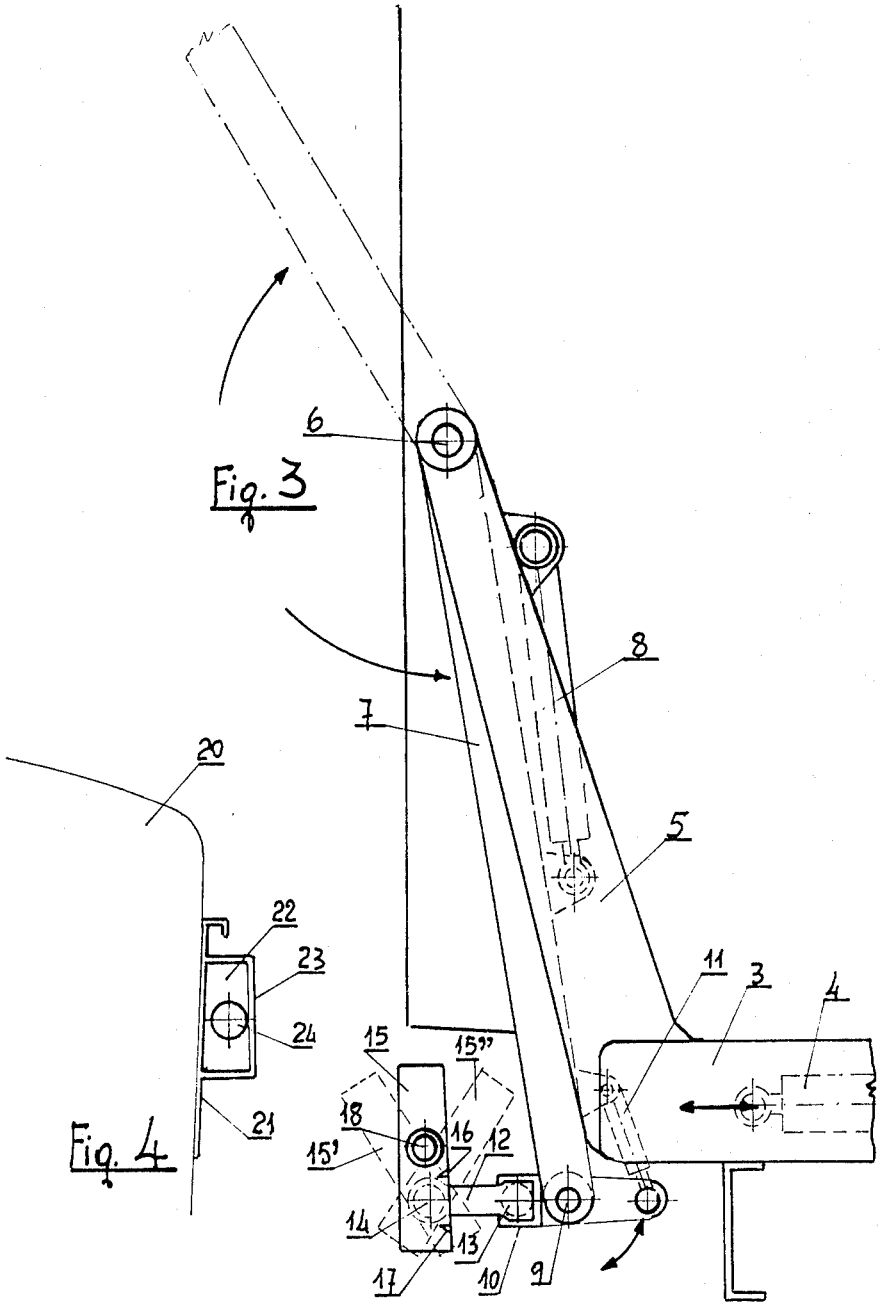
FIG. 3 shows a lateral view of the device of FIG. 1, transverse to the truck.
FIG. 4 shows a cross section of the female recess illustrated in FIG. 2.

The coupling head can freely rotate around the articulated joint 14 within a span limited by the pawls 16 and 17, as will be further explained herein after, so that the head will reach the two dashed positions 15' and 15'' in FIG. 3.

Two opposed pin teeth with lengthwise horizontal axis are located inside the coupling head 15; these pins have a tapered tip which fits into proper slots.

The opposed extraction of these pin teeth 18 is obtained by a single acting hydraulic fluid piston and cylinder 19 whereas the pins return inside the head 15 by means of return springs (not illustrated on the drawing).

These functions can also be reversed by using springs which will push out the pin teeth while the hydraulic fluid piston and cylinder will cause their return. Furthermore the utilization of a double acting hydraulic fluid piston and cylinder will also be possible.

A plate 21 bearing the female part of the coupling device is mounted on the external surface facing the road. This female part is consisting of two converging lateral walls 22, externally closed by a wall 23; these walls 22 and 23 have the same inclination as the side and back walls of the coupling head 15. The female part is open at the bottom for introduction of the coupling head 15.

The two side walls 22 have opposed holes matching the position of the pin teeth 18 of the coupling head 15 which must enter these holes. The lateral plates 22 are properly reinforced by the lateral welded flanges 25.

Functioning of the system, thus explained, is easy to imagine.

The truck will stop with the device in question already in almost central position with respect to the garbage container 21. The operator will then extract the slider 3 and will tilt the lever arm 7 by a slight angle so that the head will be facing the container. The head will be outwards slanting (in position 15') and can be centered with respect to the female by means of the piston and cylinder 13. By a combined action of the arm 7 and the piston and cylinder 11, the head 15 will then be lifted until it enters the female part fastened on the container. Operation of the piston and cylinder 19 causes the pin teeth to spring out and to enter into the holes 24 in the plate 22 of the female part, thus stably coupling the lifting device to the container.

The next actuation of the piston and cylinder 11 will lift the garbage container from the ground. The container can be tipped for discharge by retracting the slider 3 and lifting the lever arm 7 further upwards. At the end of the lift, the head will be swung in position 15'' to facilitate dumping of the garbage into the truck.

Reversed operations will return the empty container to its initial position, while releasing the coupling head.

Figure 5:
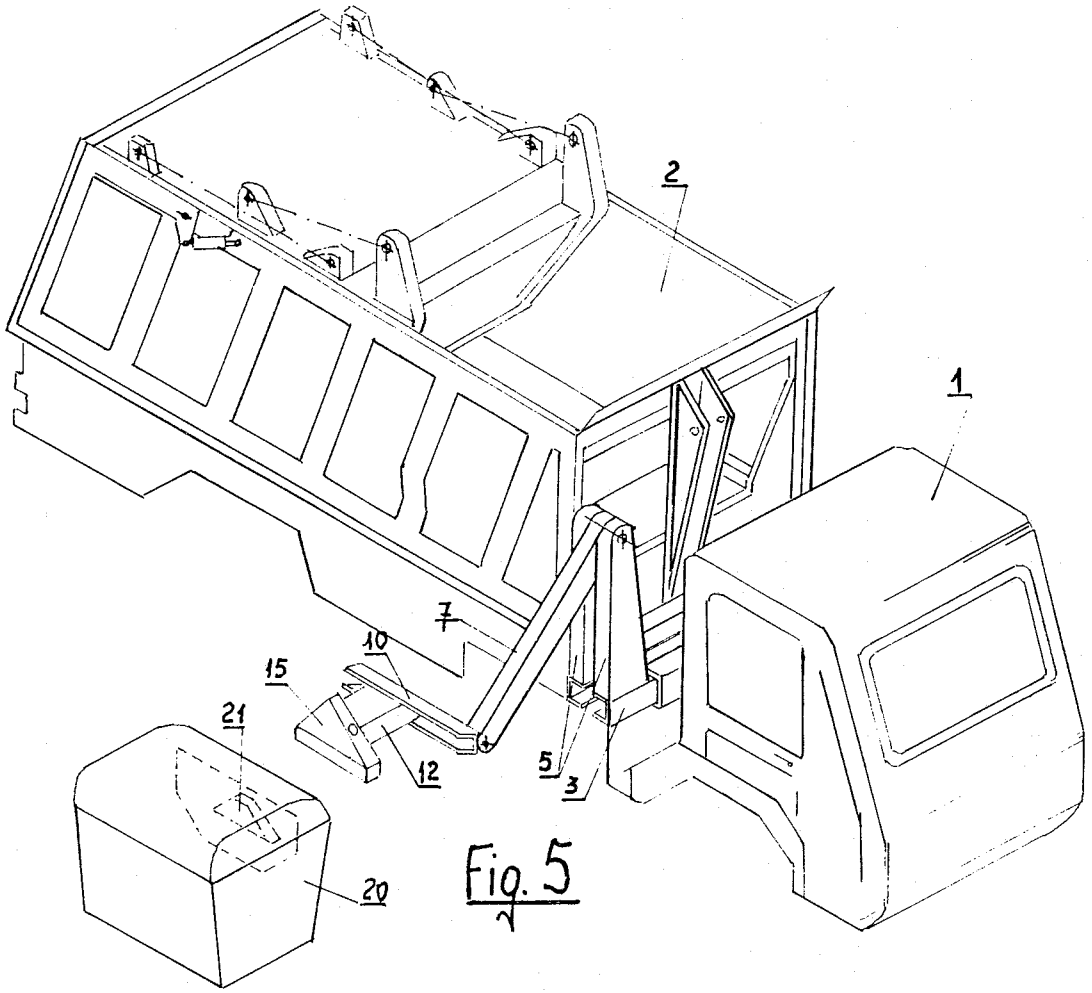
FIG. 5 shows a perspective view of the truck equipped with the outfit according to this patent.
Figure 5A:
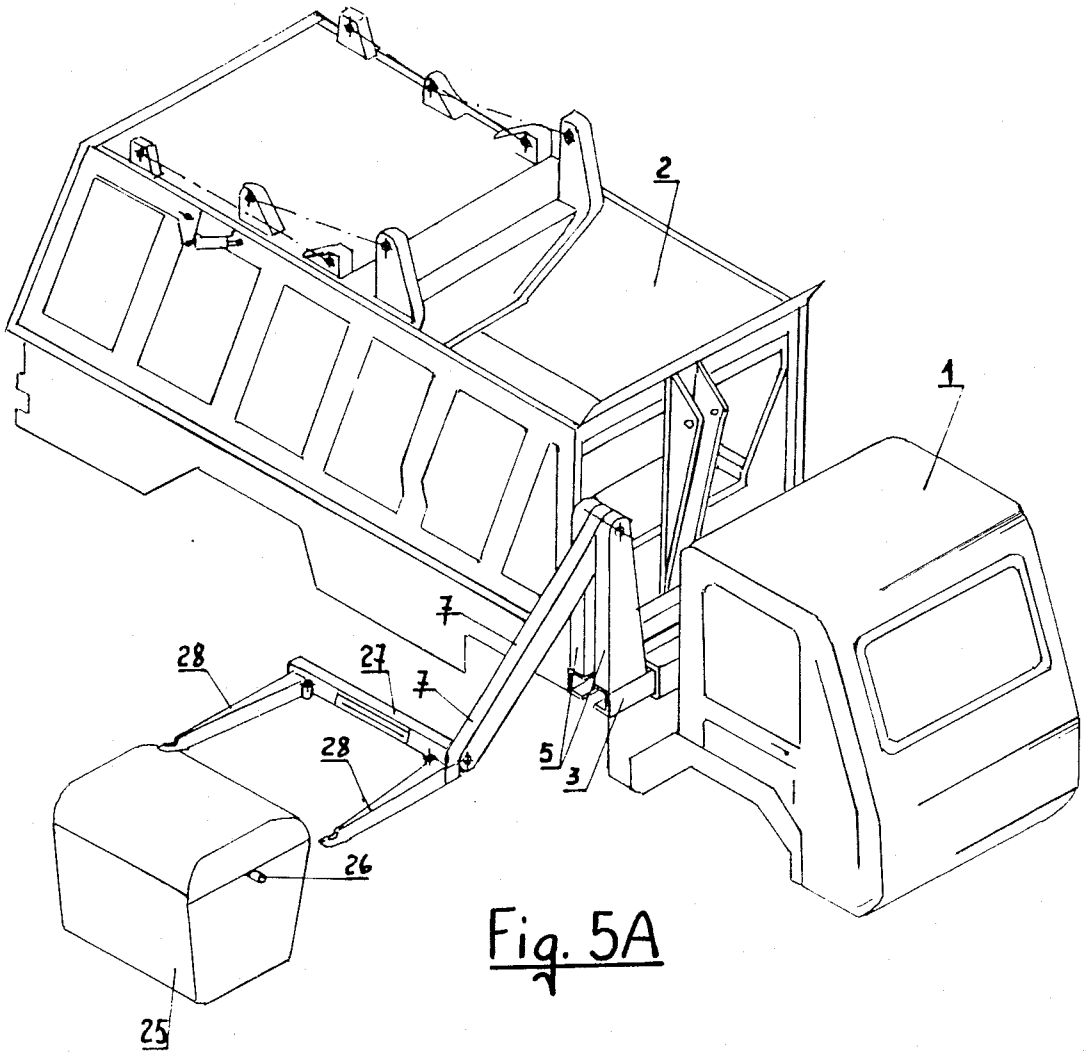
FIG. 5A is similar to FIG. 5 but shows the use of a conventional container.

FIG. 5 shows the equipment, subject matter of the patent, in which the slider 3, the upright 5 and the mobile arm 7 is be used with conventional lifting and discharging devices 27, 28 of containers 25 fitted with lateral projections 26. Therefore such normal equipment may be interchangeable with the triangular head device subject matter of this patent.

The above clearly shows the advantages of the garbage collecting system according to the patent, since it requires not much space for installation, very simple and inexpensive equipment and only one operator.

Obviously, the device is provided with everything required for automatic control and monitoring of the system.

There may be special working conditions, where a greater distance from the truck is required, as for instance when the garbage container is located at a certain distance from the roadway, e.g. on the sidewalk, or when the container is hidden by heaps of trash, or by parked cars or motorcycles, etc.

In such conditions, the garbage truck cannot come sufficiently near the container and would be unable to empty it with the described equipment.

Figure 6:
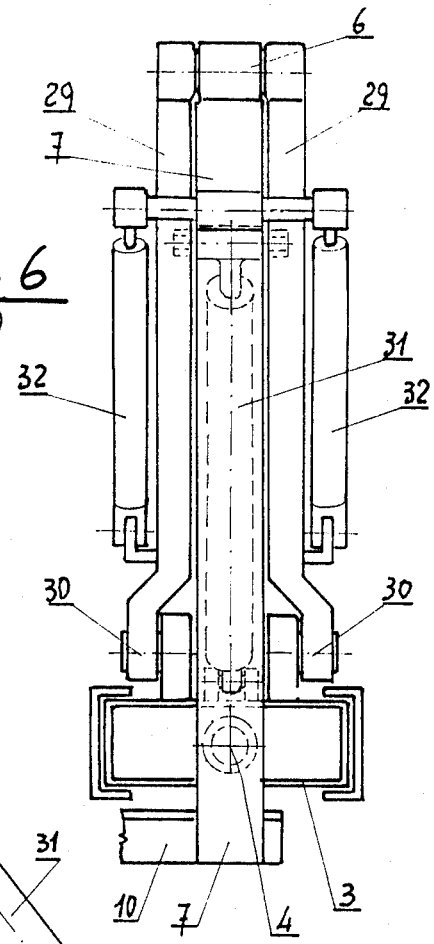
FIGS. 6 and 7 show a frontal and lateral view of the device, in which the upright is articulated on the slider.
Figure 7:
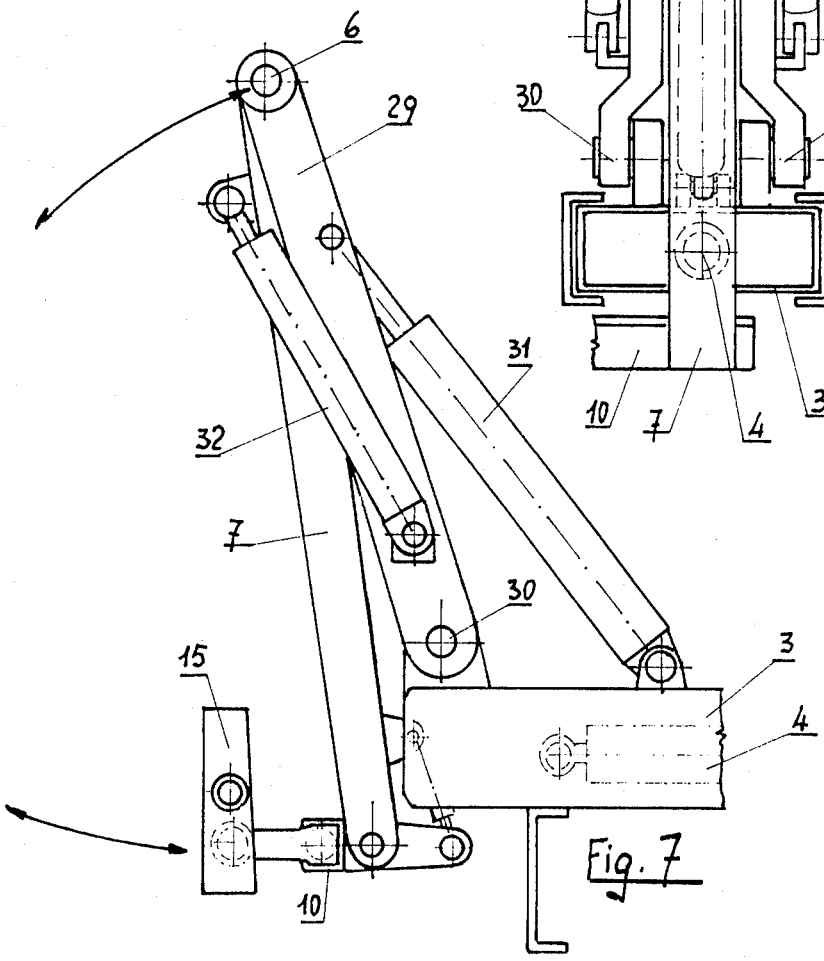

The device illustrated in FIGS. 6 and 7 has the aim to eliminate this drawback by the fact that the upright connected to the slider will be oscillating so as to increase the range of action of the device so that it will be able to reach beyond any obstacles located between the container and the garbage truck. This solution will also increase the operating capacity of the coupling head which can be more easily introduced in the female part of the container.

According to the solution in FIGS. 6 and 7, the fixed upright 5 is replaced by a first, double section lever 29, properly spaced and secured to the mobile head of the slider by means of an articulated joint 30, driven by a double acting hydraulic fluid piston and cylinder 31.

An articulated joint 6 will be secured to the upper end of this first lever 29, whereas a second lever 7 oscillating between the two sections of the first lever 29 is secured to the articulated joint 6.

Two lateral hydraulic fluid pistons and cylinder 32 will control the oscillations of the second lever arm 7.

It follows that the coupling head can be moved over a much greater distance between the truck and the container so that it will be possible to hook up garbage containers positioned at some distance from the roadway or hidden by obstacles, since the distance can be bridged both by the slider 3 and by the first lever 29 and by the second lever 7. Furthermore, this solution also improves hooking up of the containers in normal working conditions.

We claim:

1. Device for lifting, tilting and discharging of garbage containers into a collecting garbage truck, characterized by the fact that this system involves the following combination:

a slider (3) located between the driver's cab (1) and the truck body (2) into which the garbage is dumped, transversally sliding on guides by means of a double acting hydraulic fluid piston and cylinder (4) so as to come out on one side and to retract whithin the space taken up by the garbage truck, an upright (5) consisting of a double section fastened onto the mobile head of the slider (3), a lever arm (7) located between the two sections of the upright (5) and hinged onto an articulated joint (6) with lengthwise horizontal axis mounted at the free end of this upright (5), this arm (7) being oscillating between its lower rest position, the container hook-on position and its upper discharging position, by means of a hydraulic fluid double acting piston and cylinder (8), a longitudinal horizontal sectional arm (10), located at the level of the truck body (2) which receives the garbage and secured, by means of an articulated joint (9) with lengthwise horizontal axis at the free end of the lever arm (7), this sectional arm (10) being able to oscillate so that it can hook on and lift the container (20), by means of a double acting hydraulic fluid piston and cylinder (11), a plate (12), one end of which will be sliding, to facilitate coupling, in the above mentioned sectional arm (10) with the aid of a double acting hydraulic fluid piston and cylinder (13), while the other end of the plate (12) will be provided with an articulated joint (14) having a lengthwise horizontal axis, bearing the coupling head (15), a coupling head (15) having the shape of a hollow triangular prism mounted on the articulated joint (14) at the free end of the plate (12) and freely oscillating between two positions (15', 15''0), delimited by pawls (16, 17), so as to facilitate hooking up of the container and dumping of the garbage into the truck; this head (15) being provided with two opposed pin teeth (18) with tapered tip, lodged in lengthwise horizontal slots and properly actuated by a system (19) to secure and release the head in the female part fixed onto the container (20), a female part (21, 22, 23) of the coupling device, fastened onto the external frontal surface of the container (20) the lateral configuration of which will match the external configuration of the coupling head (15), while opposite holes (24) on the converging lateral surfaces (22) of this female part will be able to lodge the above mentioned pin teeth (18) of the head which shall thus enter these holes; so that it will be possible to hook up, lift and discharge the containers in the garbage truck, at a limited cost of installation, limited space requirements and with the help of only one operator who will also act as truck driver.

2. Device as described in claim 1, characterized by the fact that the control system (19) of the opposed pin teeth (18) of the head (15) in the matching holes (24) of the female part are a double acting and double head hydraulic fluid piston and cylinder, or a double head single acting hydraulic fluid piston and cylinder causing an opposed movement of the pin teeth, combined with counter springs to obtain the reverse movement.

3. Device as described in claim 1, characterized by the fact that the articulated joint (9) at the free end of the lever arm (7) can be connected to the longitudinal horizontal sectional arm (27) of a known system having arms (28) to hook up the container (25) by means of lateral pin teeth (26) so that the two arm fitted and triangular head coupling systems are interchangeable.

4. Device as described in claim 1, characterized by the fact that this requires all necessary equipment and systems for automatic control and operation by one single operator.

5. Device as described in claim 1, characterized by the fact that the upright (5) is replaced by a first lever arm (29) mounted by means of an articulated joint (30) on the mobile head of the slider (3) and oscillating by means of a double acting hydraulic fluid piston and cylinder (31), so that it will be easier to hook on the garbage container even when placed at a considerable distance from the garbage truck.

6. Device as described in claim 5, characterized by the fact that the second lever arm (7) is driven by two hydraulic fluid piston and cylinder units (32) located sideways of the first lever arm (29).

* * * * *